United States Patent [19]

Kaporovich et al.

[11] 4,059,977

[45] Nov. 29, 1977

[54] METHOD OF PRODUCING HERMETICALLY SEALED END IN A TUBULAR WORKPIECE

[76] Inventors: Vladimir Georgievich Kaporovich, ulitsa Lenina, 2, kv. 106; Vitaly Kirillovich Udovenko, ulitsa Parkovaya, 35, kv. 105, both of Kramatorsk; Viktor Petrovich Krasnorutsky, 4 Mikroraion, 5, kv. 41; Akhmet Galievich Chechenets, 5 Mikroraion, 27, kv. 41, both of Frunze, all of U.S.S.R.

[21] Appl. No.: 729,846

[22] Filed: Oct. 5, 1976

[51] Int. Cl.[2] ..... B21D 41/04

[52] U.S. Cl. ..... 72/69; 72/81; 72/84; 228/60; 29/161

[58] Field of Search ..... 29/149.5 B, 161; 228/60; 113/116 AA, 120 S; 72/69, 81, 82, 83, 84, 85

[56] References Cited

U.S. PATENT DOCUMENTS

| | | | |
|---|---|---|---|
| 1,712,118 | 5/1929 | Powers | 72/69 |
| 2,286,511 | 6/1942 | Schulenberg | 228/60 |

*Primary Examiner*—Lowell A. Larson

*Attorney, Agent, or Firm*—Fleit & Jacobson

[57] ABSTRACT

A method of producing a hermetically sealed, preferably sphere-shaped end in a tubular workpiece, residing, according to the invention, in that an end of a tubular workpiece is heated to a forging temperature and is then reduced until a portion is obtained with a diameter equal to that of a sphere to be obtained. Afterwards, a semi-sphere is subjected to spinning applied to the end of said reduced portion until a hermetically sealed end is formed. This is followed by spinning of a necking portion until a sphere is obtained, the spinning of the constricted portion being carried out as starting from the conjugating line running between the semi-sphere obtained and the reduced portion along the sphere generatrix towards the main portion of the workpiece.

2 Claims, 3 Drawing Figures

METHOD OF PRODUCING HERMETICALLY SEALED END IN A TUBULAR WORKPIECE

The present invention relates to metal working, and more particularly to methods of producing hermetically sealed ends in tubular workpieces.

The proposed invention may be suitably used in the production of hollow axisymmetric articles form tubular workpieces, for example, in the production of a hollow plunger spherical bearing for tipping truck hydraulic jacks, hydraulic fixtures, various articulated joints in metal constructions, and telescopic articulated joints.

Known in the prior art is a method of producing a hermetically sealed end in a tubular workpiece, which lies in that a cylindrical core is inserted into a tubular workpiece. Next the end portion of the tube is subjected to roll-forming with a roller which while moving under pressure presses individual portions of the tube to the core. The roll-forming process being over, the core is removed from the article.

This method suffers from a number of disadvantages, e.g., the thickness of the tubular workpiece wall being not uniform in all sections, an additional welding operation is therefore required to ensure tightness of the tubular workpiece end.

The aforesaid method is not efficient since the roll-forming process with the workpiece end is carried out through numerous successive roller passes. According to this method, the tubes which undergo such operation have thin walls. To carry out the operation of the type described with thick-walled tubular workpieces, it is necessary to apply quite considerable roller pressing force to the metal.

The method of producing a hermetically sealed end in a tubular workpiece as applied at present is realized through welding a pre-stamped sphere-shaped workpiece to a tube.

This method has a number of disadvantages, namely: a sphere-shaped workpiece pre-stamping operation is necessary, which requires special equipment, as well as designing and manufacturing of a stamp; the stamped work-pieces are to be delivered to the place of assembly, which involves extra expenses for transportation and stowage thereof. The stamped workpieces are then machined and welded to the preconditioned tube. The aforementioned operations will require several metal-cutting machines and skilled operators.

The hereinbefore described method is inefficient in that it takes up a lot of time to obtain the end product, this being a properly roll-shaped spherical workpiece. Besides, the sphere-shaped workpiece is made all-metal which adds to its weight and results in abnormally high metal consumption.

There is also known a method of producing a hollow, hermetically sealed end in a tubular workpiece by way of roll-shaping process. This method resides in that a tubular workpiece, having its end heated to a forging temperature, is made to rotate about its axis. A forming tool is made to travel perpendicular to the axis of rotation of the workpiece.

The tool used for the purpose has such a configuration that its successive sections make for smooth transitions from the initial shape of the workpiece generatrix to a desired shape thereof. In the course of the interaction between the rotating workpiece and the tangentially moving tool, the end of the workpiece is caused to deform.

However, the described method is not fit for obtaining articles with a more complicated geometry of their hermetically sealed end, such as hollow plungers with a sphere-shaped hermetically sealed end.

Accordingly, it is an object of the present invention to obviate the aforecited prior-art disadvantages.

It is also an object of the invention to enhance tightness of the workpiece end joint.

It is another object of the invention to increase the strength of a neck portion between the spherical and cylindrical portions of a workpiece.

It is still another object of the invention to improve accuracy of the workpiece geometry.

Yet another object of the invention is to bring down consumption of metal required for producing hermetically sealed ends in tubular workpieces.

It is still another object of the invention to cut down time required for producing a sphere-shaped hermetically selaed end in a tubular workpiece.

It is therefore an object of the present invention to provide a method of producing a hermetically sealed end in a tubular workpiece, whereby it would be possible to obtain a hollow sphere at the end of a tubular workpiece, the diameter of said sphere being less that that of the workpiece.

These and other objects of the invention are accomplished by a method of producing a hermetically sealed end in a tubular workpiece by way of successively spinning an end of a tubular workpiece, heated to a forging temperature, with a profile tool wherein, according to the invention, the workpiece end, heated to a forging temperature, is reduced until a cylinder-shaped portion is obtained with a diameter equal to that of a sphere to be obtained, then a semi-sphere is spun at the end of the reduced portion of the tubular workpiece with a formation of a hermetically sealed end, this being followed by spinning a necking portion until a sphere is obtained, the process of spinning of the necking portion being carried out as starting from the conjugating line running between the semi-sphere obtained and the reduced cylinder-shaped portion along the sphere generatrix towards the main portion of the workpiece until an intermediate neck portion with a prescribed diameter is obtained.

Reduction of the tubular workpiece end makes it possible to decrease the workpiece diameter over the requisite length, which will permit obtaining the diameter equal to that of a sphere to be obtained.

Spinning of the reduced portion of the tubular workpiece results in the semi-spheric portion obtained in the workpiece with a hermetically sealed joint.

Spinning of the neck portion along the sphere geneatrix within the reduced portion makes is possible to obtain, deformation forces being uniformly distributed, the semi-sphere portion in the workpiece starting from the conjugating line of the semi-shere within the cylinder-shaped portion of said workpiece. Owing to this a sphere is formed at the end of the tubular workpiece.

The invention will be further described in terms of specific embodiments thereof, taken in conjunction with the accompanying drawings, wherein.

The herein proposed method of producing a hermetically sealed end in a tubular workpiece is realized as follows.

Figure 1:
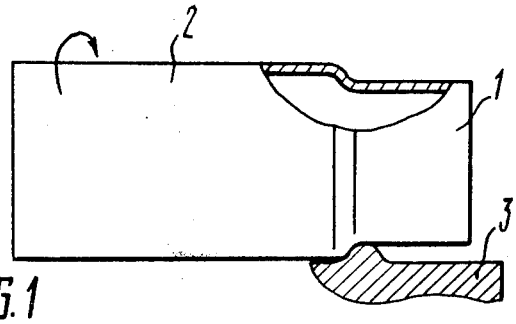
FIG. 1 shows the mutual arrangement of an end of a tubular workpiece and a friction tool when subjecting the workpiece end to reduction.

An end I (FIG. 1) of a tubular workpiece 2 is heated to a forging temperature, that is the temperature permitting plastic deformation of metal and determined by the sort of steel used.

The tubular workpiece 2 is clamped for example in a lathe chuck /not shown/ and is brought into rotation about its axis with a speed ranging from 400 to 800 rpm, the speed being set up according to the thickness of the workpiece wall and the cool-off time of the heated end. The tubular workpiece heating temperature in the course of spinning should not drop below the forging temperature.

Afterwards, a tool 3 is set in translating motion, said tool having sucessively profiled shaping surface. The tool 3 is advanced perpendicular to the axis of the workpiece 2 so that in the course of its travel it is brought into contact with the heated tubular workpiece 2, causing the latter to deform.

Then, the end I of the tubular workpiece 2, said end being heated to a forging temperature, is subjected to reduction over the requisite length which must ensure geometrical dimensions of the end I, sufficient to obtain a sphere. The reducing operation allows diminishing the tubular workpiece 2 to a diameter equal to that of the sphere to be obtained.

Figure 2:
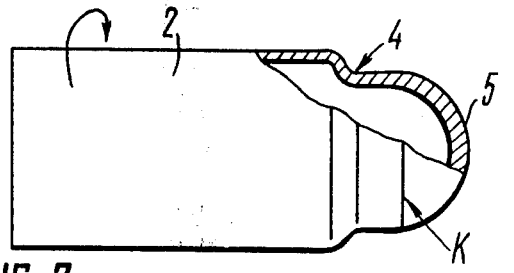
FIG. 2 shows a reduced end of a workpiece with a semi-sphere formed by spinning.
Figure 3:
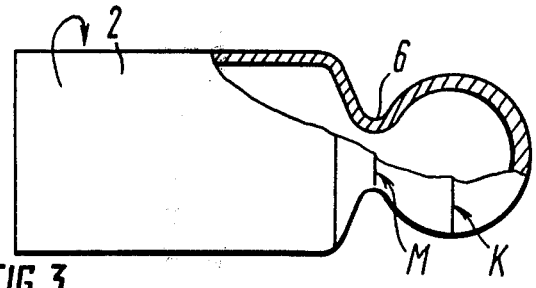
FIG. 3 shows an end of a tubular workpiece with a sphere formed by spinning.

Further on, a semi-sphere 5 of the tubular workpiece 2 is spun at the end I of a reduced portion 4 (FIG. 2) with a formation of a hermetically sealed end. A necking portion is then formed by spinning until a sphere is obtained (FIG. 3). The spinning of the necking portion is carried out as starting from the conjugating line "K" running between the semi-sphere and the cylindrical reduced portion 4 of the end I of the tubular workpiece 2 along sphere generatrix towards the main portion of the tubular workpiece 2 (towards line "M") until an intermediate neck 6 of a prescriped diameter is obtained.

The sequence of operations in forming the neck portion as described above has direct bearing upon uniform distribution of the metal deformation along the sphere generatrix in view of smaller resistance offered by the workpiece 2 with a diminishing diameter of the neck portion. Therefore, spinning of the necking portion is carried out starting from the section with the highest moment of resistance, i.e., from line "K" towards the section with the lowest moment of resistance, that is, towards line "M". Forming of the neck portion in reverse sequence will lead to destruction of the tubular workpiece and the sphere break-away from the main portion due to an axial force arising at the point of contact between the tool and the tubular workpiece.

The herein-disclosed method can find wide application in manufacturing hydraulic fixtures, hollow plungers of telescopic hydraulic jacks for tipping trucks, as well as spherical bearing for articulated joints, etc.,

What is claimed is:

1. A method of producing a sphere having a hermetically sealed end at an end of a tubular cylindrically shaped workpiece, wherein the diameter of the sphere is less than the diameter of the tubular workpiece, comprising the steps of heating a tubular workpiece end to a forging temperature; reducing the diameter of said end of the tubular heated workpiece until a tubular end portion is obtained with a diameter equal to the diameter of the sphere to be formed; roll-shaping the end portion of the reduced diameter tubular end portion of the workpiece until a semi-spherical shaped hermetically sealed end is formed; roll-shaping the remaining portion of the reduced diameter end portion of the workpiece to form a sphere comprising the steps of roll-shaping the reduced diameter portion of the workpiece starting from the conjugation between said semi-sphere shaped portion and said cylinder-shaped reduced diameter portion along a sphere generatrix towards the main portion of said workpiece until an intermediate neck portion with a prescribed diameter is formed.

2. The method as claimed in claim 1 wherein said step of reducing the diameter of said end of the tubular workpiece comprises providing a profile tool adjacent said tubular workpiece, spinning said tubular workpiece about its axis, and moving said profile tool perpendicular to said axis into engagement with said tubular workpiece.

* * * * *